US012173502B2

(12) United States Patent
Bailey et al.

(10) Patent No.: US 12,173,502 B2
(45) Date of Patent: Dec. 24, 2024

(54) CEILING BAFFLE ATTACHMENT STRUCTURE AND CEILING SYSTEM

(71) Applicant: CertainTeed Ceilings Corporation, Malvern, PA (US)

(72) Inventors: David A. Bailey, Norcross, GA (US); Michael Magin, Cumming, GA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 307 days.

(21) Appl. No.: 17/820,645

(22) Filed: Aug. 18, 2022

(65) Prior Publication Data

US 2023/0055540 A1 Feb. 23, 2023

Related U.S. Application Data

(60) Provisional application No. 63/235,517, filed on Aug. 20, 2021.

(51) Int. Cl.

| | |
|---|---|
| ***E04B 9/18*** | (2006.01) |
| ***E04B 1/84*** | (2006.01) |
| ***E04B 9/34*** | (2006.01) |

(52) U.S. Cl.

CPC ..... *E04B 9/18* (2013.01); *E04B 1/8404* (2013.01); *E04B 9/34* (2013.01)

(58) Field of Classification Search

CPC . E04B 9/18; E04B 1/8404; E04B 9/34; E04B 9/20; E04B 9/366

See application file for complete search history.

(56) References Cited

U.S. PATENT DOCUMENTS

| | | | | |
|---|---|---|---|---|
| 3,018,080 | A | 1/1962 | Loudon | |
| 3,390,856 | A * | 7/1968 | Buren, Jr. | F16B 2/245 248/228.3 |
| 4,197,923 | A | 4/1980 | Harris | |
| 5,653,412 | A | 8/1997 | Martorano | |
| 8,327,591 | B2 * | 12/2012 | Wilkinson, Jr. | E04B 9/366 52/506.07 |
| 9,038,344 | B2 * | 5/2015 | Mayer | F21V 33/006 52/39 |

(Continued)

FOREIGN PATENT DOCUMENTS

WO 2021/083863 A2 5/2021

OTHER PUBLICATIONS

Eaton Corporation, "Eaton's B-Line series Fasteners," p. 87 (2020).

*Primary Examiner* — Rodney Mintz

(74) *Attorney, Agent, or Firm* — McDonnell Boehnen Hulbert & Berghoff LLP

(57) ABSTRACT

The present disclosure relates generally to ceiling attachments, for example, suitable for securing ceiling baffles to a ceiling grid. The present disclosure relates more particularly to a ceiling baffle attachment structure including a ceiling grid clip configured to attach to lateral flanges of a ceiling grid beam and a post extending down from the ceiling grid clip. The structure also includes a ceiling baffle having an upper side and a lower side and extending along a length from a first end to a second end. The ceiling baffle includes a bracket disposed at the upper side that comprises a T-slot extending along the length of the ceiling baffle. A retainer is secured to the post and includes a first shoulder engaging the T slot so as to secure the ceiling baffle to the ceiling grid clip.

20 Claims, 11 Drawing Sheets

(56) References Cited

U.S. PATENT DOCUMENTS

| | | | | |
|---|---|---|---|---|
| 10,174,501 | B1 * | 1/2019 | Underkofler | E04B 9/183 |
| 10,889,987 | B2 | 1/2021 | Patterson | |
| 11,608,636 | B1 * | 3/2023 | Underkofler | E04B 9/068 |
| 2011/0232219 | A1 * | 9/2011 | Wilkinson, Jr. | E04B 9/366<br>52/474 |
| 2013/0047541 | A1 * | 2/2013 | Mayer | E04B 9/065<br>52/506.05 |
| 2015/0059279 | A1 | 3/2015 | Harper | |
| 2022/0018127 | A1 * | 1/2022 | Magin | E04B 9/18 |
| 2022/0372753 | A1 * | 11/2022 | Verlinde | E04B 1/84 |
| 2024/0151030 | A1 * | 5/2024 | Verlinde | F16B 5/121 |

* cited by examiner

CEILING BAFFLE ATTACHMENT STRUCTURE AND CEILING SYSTEM

CROSS-REFERENCE TO RELATED APPLICATIONS

This application claims the benefit of priority of U.S. Provisional Application No. 63/235,517, filed Aug. 20, 2021, which is hereby incorporated herein by reference in its entirety.

BACKGROUND OF THE DISCLOSURE

1. Field of the Disclosure

The present disclosure relates generally to ceiling systems, for example, suitable for providing a building surface over an enclosed space. The present disclosure relates more particularly to an attachment structure for securing ceiling baffles to a ceiling grid.

2. Technical Background

Ceiling baffles are convenient and effective for constructing interesting ceiling surfaces. The baffles may be prefabricated and shipped to the construction location, allowing for efficient installation that covers a large surface area. If damaged, the baffles can be replaced, rather than requiring a custom repair of the architectural surface.

Baffles that are used to form an architectural surface, such as a ceiling, are often supported by a structural grid that holds the baffles in place. This allows flexibility in the design of the baffles, because the supporting grid provides the structural integrity needed for the architectural surface, thereby allowing the design of the baffles to address aesthetic and acoustic requirements of the ceiling system. Various methods are used to secure the baffles to the ceiling grid. Typically, these methods involve complex connections to secure the baffles to directly to the ceiling grid, or specific carriers that are attached to the grid and hold several baffles.

While these methods are effective, the complexity of the associated systems can add costs may be complex to assemble. The present inventors have recognized that an attachment structure that is less complicated and easy to assemble would be attractive to builders and customers.

SUMMARY OF THE DISCLOSURE

In one aspect, the present disclosure provides a ceiling baffle attachment structure comprising:

- a ceiling grid clip configured to attach to lateral flanges of a ceiling grid beam;
- a post extending down from the ceiling grid clip;
- a ceiling baffle having an upper side and a lower side and extending along a length from a first end to a second end, the ceiling baffle including a bracket disposed at the upper side that comprises a T-slot extending along the length of the ceiling baffle; and
- a retainer secured to the post, the retainer including a first shoulder engaging the T slot so as to secure the ceiling baffle to the ceiling grid clip.

In another aspect, the disclosure provides a ceiling system comprising:

- a ceiling grid comprising a plurality of ceiling grid beams including a first ceiling grid beam; and

- a first ceiling baffle attached to the first ceiling grid beam using a ceiling baffle attachment structure according to the disclosure.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

FIG. 10 is a side view of a portion of the ceiling system of FIG. 1A;

DETAILED DESCRIPTION

As described above, the present inventors have noted that an alternative structure for securing baffles to a ceiling grid would be beneficial.

Accordingly, one aspect of the disclosure is a ceiling baffle attachment structure including a ceiling grid clip configured to attach to lateral flanges of a ceiling grid beam and a post extending down from the ceiling grid clip. The structure also includes a ceiling baffle having an upper side and a lower side and extending along a length from a first end to a second end. The ceiling baffle including a bracket disposed at the upper side that comprises a T-slot extending along the length of the ceiling baffle. A retainer is secured to the post and includes a first shoulder engaging the T slot so as to secure the ceiling baffle to ceiling grid clip.

Figure 1A:
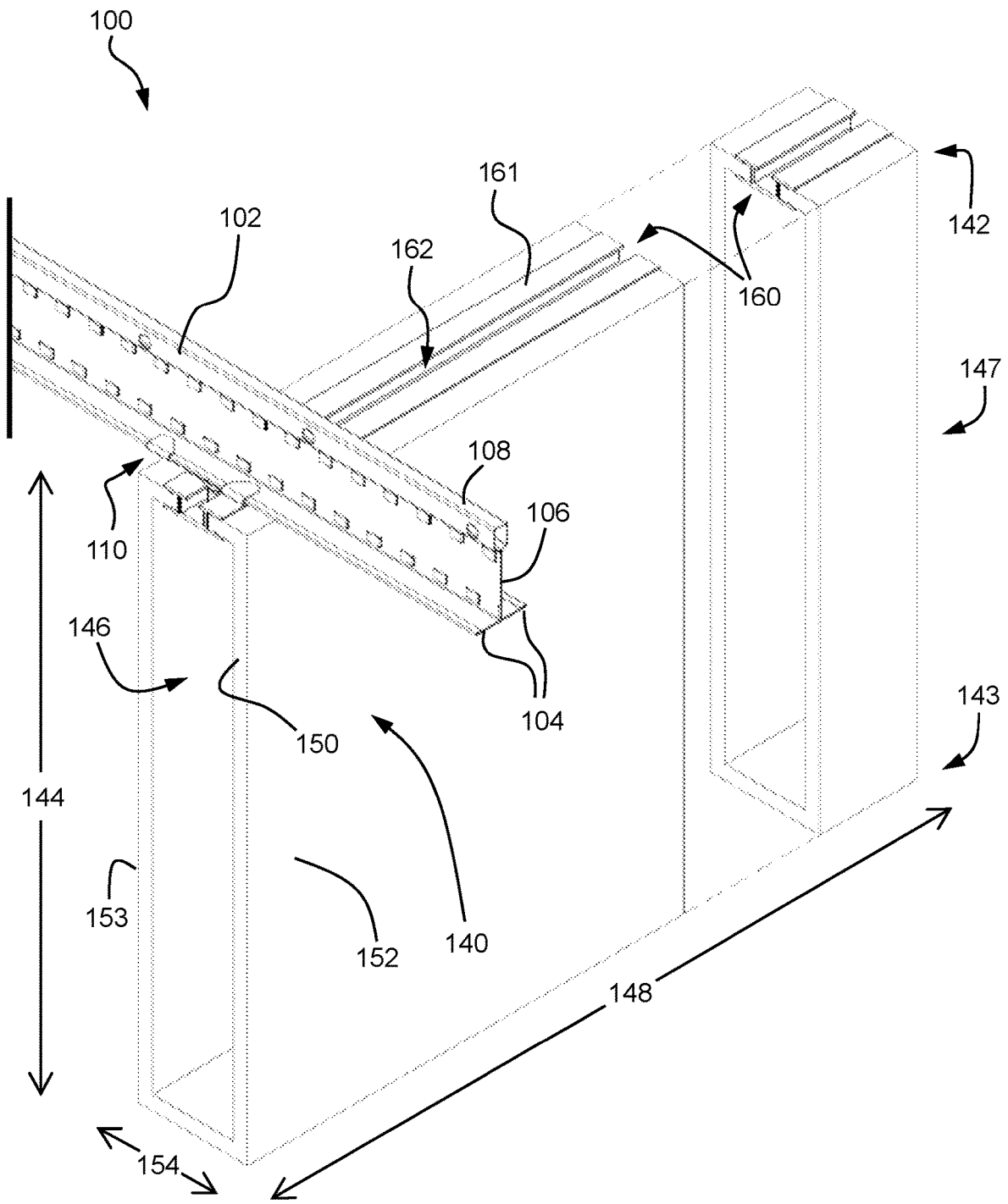
FIG. 1A is a schematic perspective view of a portion of a ceiling system according to an embodiment of the disclosure.

A portion of a ceiling system using such an attachment structure is shown in a perspective view in FIG. 1A and a side view in FIG. 10. Ceiling system 100 includes a ceiling grid beam 102 and a ceiling baffle 140 attached to ceiling grid beam 102. Ceiling baffle 140 has a height 144 extending from an upper side 142 to a lower side 143, a length 148 extending from a first end 146 to a second end 147, and a width 154 between a first face 152 and a second face 153.

Baffle 140 includes a bracket 160 that is positioned at upper side 142. A T-slot 162 is formed in the upper surface 161 of bracket 160 and extends along the length 148 of baffle 140.

The T-slot 162 extending along bracket 160 is used to secure baffle 140 to ceiling grid beam 102 using a ceiling grid clip 110. As shown in FIG. 10, a post 118 extends down from ceiling grid clip 110 and a retainer 120 is attached to the post 118. As shown more clearly in FIG. 1D, where retainer 120 is spaced from baffle 140, retainer 120 includes a first shoulder 124 that engages a first inwardly extending lip 163 that borders the opening to T-slot 162. Accordingly, bracket 160 hangs from retainer 120 so as to suspend baffle 140 from ceiling grid beam 120.

In certain embodiments of the ceiling baffle attachment structure as otherwise described herein, the retainer is an annular element that surrounds the post and is captured in the T-slot. For example, retainer 120 in ceiling system 100 is a washer with an annular configuration that surrounds post 118. In view of the annular shape of retainer 120, the first shoulder 124 extends around the post such that retainer 120 engages both the first inwardly extending lip 163 and a second inwardly extending lip 173 on opposing sides of the opening of T-slot 162.

To secure baffle 140 to ceiling grid beam 102 using retainer 120, retainer 120 may be inserted into T-slot 162 of bracket 160 at the first end 146 or second end 147 of baffle 140 with post 118 extending through the opening of T-slot 162. The position of retainer 120, post 118 and ceiling grid clip 110 can then be adjusted along the length of baffle 140 by sliding retainer 120 through T-slot 162 so that ceiling grid clip 110 is aligned with ceiling grid beam 102. Baffle 140 may then be secured to ceiling grid beam 102 by attaching ceiling grid clip 110 to ceiling grid beam 102.

Retainer 120 is configured as an annular element with a through hole so as to have the shape of a washer. In other embodiments, however, the retainer may be configured as a cap that is secured over the lower end of the post. For example, the retainer may have a blind hole on one side and the post may be inserted into the hole such that an end of the post is covered. Moreover, in some embodiments, the retainer may be integrally formed with the post. For example, in some embodiments, the retainer and post may be formed as an integrated bolt, where the post is the shaft of the bolt and the retainer is formed by a head of the bolt.

Further, while retainer 120 has a cylindrical shape with a round outer surface, in other embodiments the retainer has an annular element with another configuration. For example, in some embodiments, the retainer has flat sides around the annular outer surface, such as a hex nut. In other embodiments, the retainer is configured as a T-slot nut that is shaped to fit within the T-slot of the bracket of the ceiling baffle.

In other embodiments, the retainer has another configuration. For example, in some embodiments, the retainer is a clip, as shown and described in more detail below. In other embodiments, the retainer is a hook. For example, in some embodiments, the retainer includes a shoulder, such as on a hook, that only engages one side of the T-slot. Still in other embodiments, the retainer has another configuration that engages the T-slot.

In certain embodiments of the ceiling baffle attachment structure as otherwise described herein, the post is threaded. The threads may be used to help secure components to the post. For example, parts of the ceiling grid clip, retainer or other fastening components may utilize the threads of the post for securing these components in place. For example, in certain embodiments of the ceiling baffle attachment structure as otherwise described herein, the structure further includes a nut disposed on the post, wherein the nut secures the bracket against the retainer. Such a nut is included in ceiling system 100. Bracket 160 of baffle 140 is secured to retainer 120 using a nut 119, as shown in FIG. 10. In particular, the first inwardly extending lip 163 and second inwardly extending lip 173 on opposing sides of T-slot 162 are clamped against retainer 120 by tightening nut 119 toward the lower end of post 118 on the threads of post 118.

In certain embodiments of the ceiling baffle attachment structure as otherwise described herein, the retainer engages the threads of the post. For example, in some embodiments, an annular interior surface of the retainer includes threads configured to mate with threads of the post so as to secure the retainer on the post. In other embodiments, the inner surface of the retainer is formed by a softer material than the post so that the threads of the post carve grooves into the retainer to secure the retainer in place. For example, the post may be formed of a metal and the interior surface of the post may be formed of a plastic that will deform upon insertion of the post.

Still, in other embodiments, an annular interior surface of the retainer is not threaded and the retainer is secured to the post by another method. For example, in certain embodiments of the ceiling baffle attachment structure as otherwise described herein, the retainer is bonded to the post. In some embodiments, the retainer is welded to the post. In other embodiments, the retainer is secured to the post using a bonding agent, such as an adhesive. Moreover, in some embodiments, the retainer is secured to threads of the post and also bonded to the post.

Further still, in some embodiments, the post is not threaded. For example, in some embodiments, the post has an unthreaded exterior and the retainer is bonded or otherwise fastened to the post.

Figure 2A:
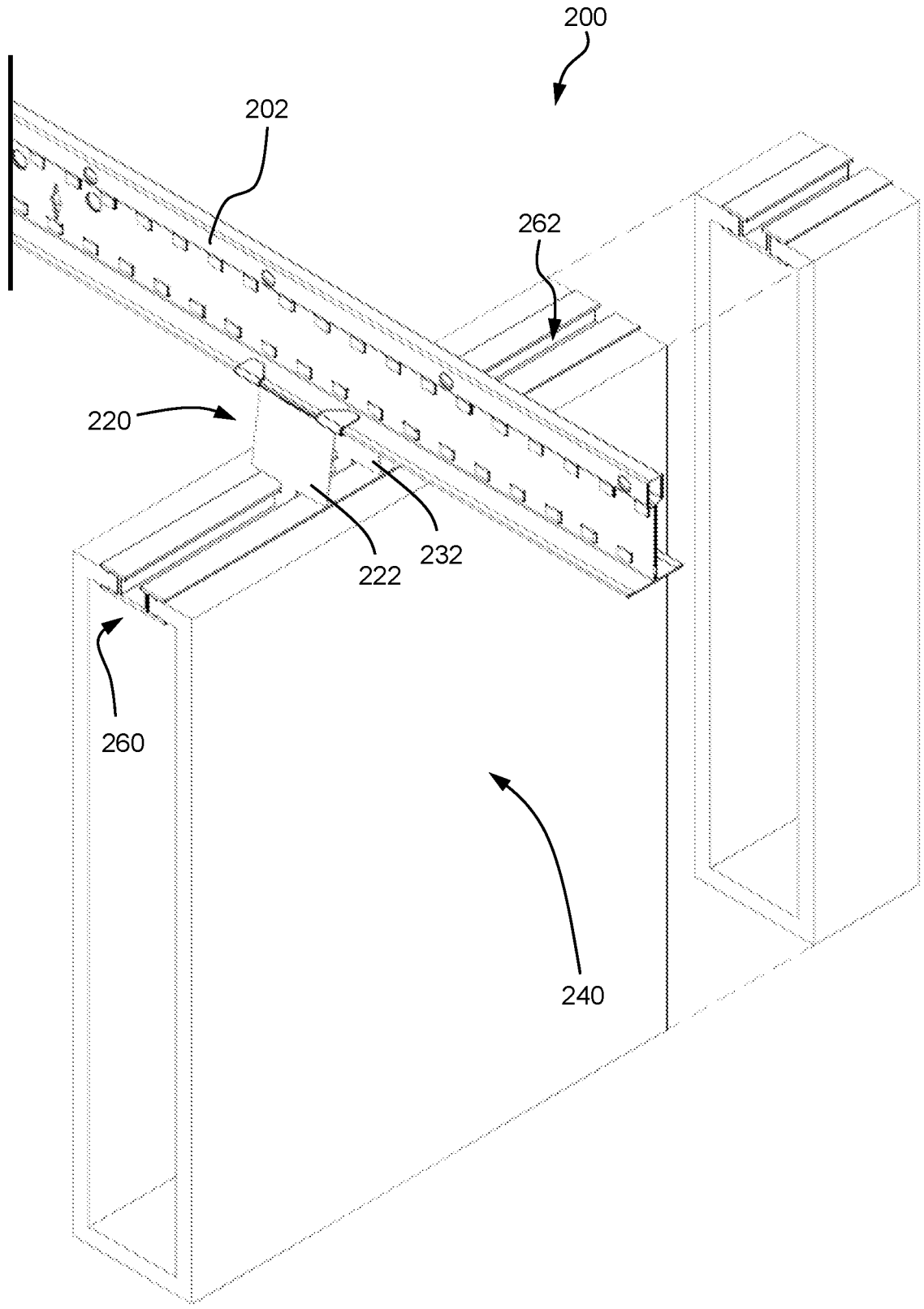
FIG. 2A is a schematic perspective view of a portion of a ceiling system according to another embodiment of the disclosure.
Figure 2B:
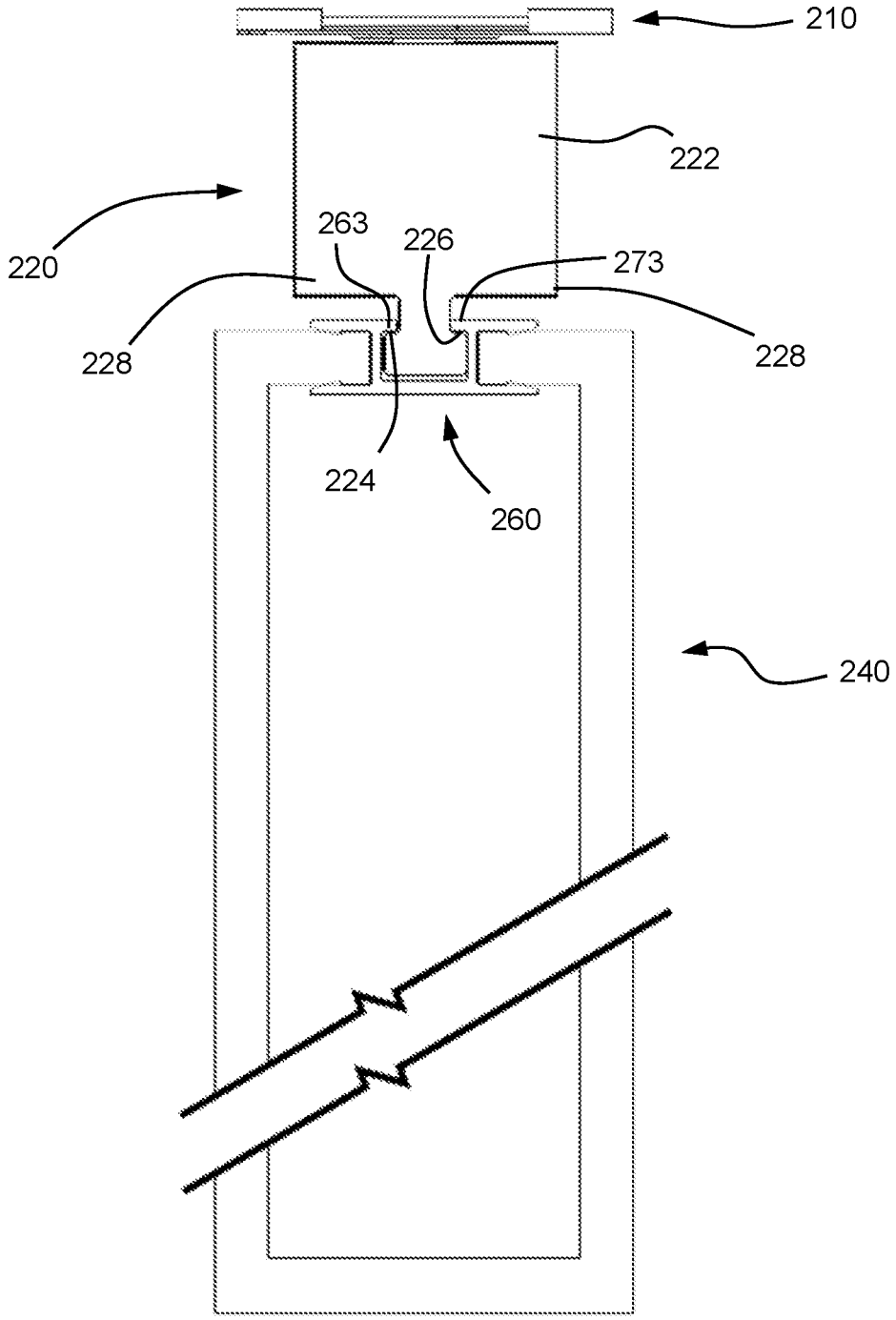
FIG. 2B is a side view of a portion of the ceiling system of FIG. 2A.
Figure 2C:
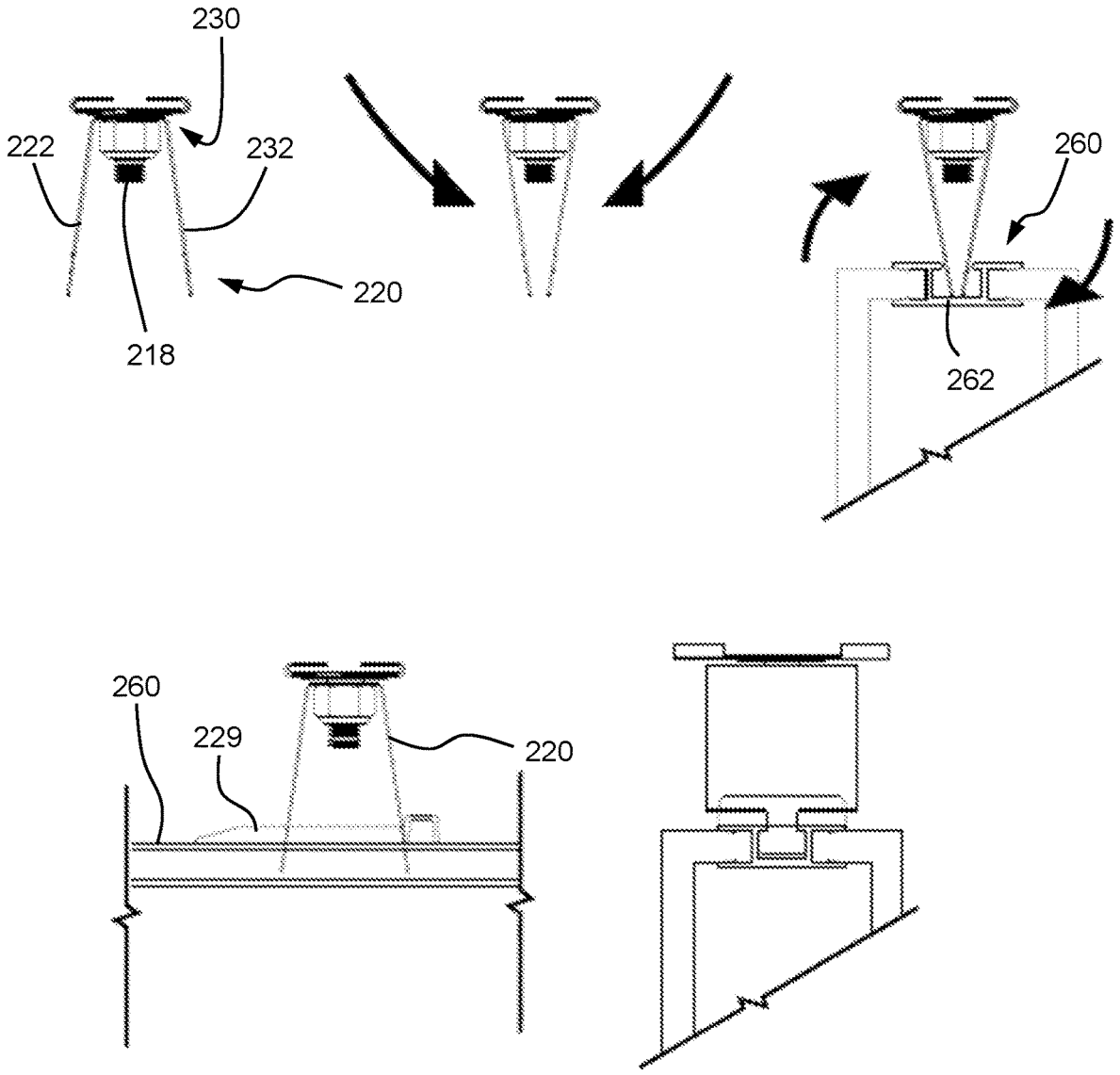
FIG. 2C is a side view of a series of steps for securing portions of the ceiling system of FIG. 2A together.

In certain embodiments of the ceiling baffle attachment structure as otherwise described herein, the retainer is a clip that extends into the T-slot so as to hold the bracket of the baffle in a suspended position. Such an embodiment is shown in FIGS. 2A-2C. Ceiling system 200 includes a ceiling grid beam 202 and a ceiling baffle 240 attached to ceiling grid beam 202. Ceiling baffle 240 includes a bracket 260 with a T-slot 262 that extends along the length of baffle 240. A retainer 220 formed as a clip extends into T-slot 262 so as to suspend baffle 240 from ceiling grid beam 202.

In certain embodiments of the ceiling baffle attachment structure as otherwise described herein, the retainer includes a first leg that extends into the T-slot, and a first shoulder that extends laterally outward from the first leg. For example, retainer 220 includes a first leg 222 that extends into T-slot 262. As shown more clearly in FIG. 2C, first leg 222 extends down from a base 230 that is secured on post 218 using a nut. As shown in FIG. 2B, at the lower end of first leg 222, retainer 220 includes a first shoulder 224 that engages with the first inwardly extending lip 263 that defines the opening to slot 262 (FIG. 2A). Accordingly bracket 260 hangs from retainer 220 on first shoulder 224.

In certain embodiments of the ceiling baffle attachment structure as otherwise described herein, the retainer includes a second shoulder extending laterally outward from the first leg opposite the first shoulder. For example, as shown in FIG. 2B, retainer 220 includes a second shoulder 226 that extends laterally outward from first leg 222 in a direction opposite to first shoulder 224. This allows retainer 220 to engage both sides of T-slot 262. In particular, first inwardly extending lip 263 of bracket 260 rests on first shoulder 224, while second inwardly extending lip 273 of bracket 260 rests on second shoulder 226.

In certain embodiments of the ceiling baffle attachment structure as otherwise described herein, the retainer includes a second leg that extends into the T-slot, and third and fourth shoulders extend laterally outward from the second leg so as to engage the T-slot. For example, retainer 220 includes a second leg 232 that is visible in FIG. 2A. Second leg 232 has a similar configuration to first leg 222 and includes opposing third and fourth shoulders that extend laterally outward from second leg 232.

Retainer 220 can be secured in bracket 260 in a similar manner to retainer 120, by inserting the end of the legs into the bracket at either end and by sliding retainer 220 into position along the length of baffle 240. Alternatively, as shown in FIG. 2C, retainer 220 can be inserted into T-slot 262 of bracket 260 by squeezing the first and second legs 222, 232 together and inserting the ends of the legs and corresponding shoulders into T-slot 262 and then twisting retainer 220 so that the shoulders engage the inwardly extending lips on opposing sides of the opening of the T-slot. On the other hand, in some embodiments, where the retainer has a single leg, it may be inserted into the T-slot and rotated without the need to flex or squeeze portions of the retainer clip.

The use of two legs in retainer 220 helps avoid unintended rotation of the retainer, which could otherwise allow the shoulders to align with the opening in the T-slot and the bracket to fall off the retainer. The spaced apart positioning of first leg 222 and second leg 232 hinders rotation of retainer 220 unless the legs are brought toward one another.

While each of the legs in retainer 220 includes two shoulders that engage both sides of the T-slot, in other embodiments, the retainer includes legs that respectively engage one side of the T-slot. For example, in some embodiments, the retainer is a clip with a pair of legs and each leg in the pair includes a shoulder configured to engage a respective inwardly extending lip on opposite sides of the opening of the T-slot. In such a configuration, the paired legs may flex toward one another to snap into place in the T-slot.

In certain embodiments of the ceiling baffle attachment structure as otherwise described herein, the first leg includes a projection that extends over an upper surface of the bracket. For example, as shown in FIG. 2B, first leg 222 includes two projections 228 that extend laterally outward from the center of first leg 222 over the bracket on opposing sides of the T-slot. The projections 228 of first leg 222 can be used to help secure baffle 240 to retainer 220. For example, in certain embodiments of the ceiling baffle attachment structure as otherwise described herein, the structure further includes a shim disposed between the projection of the first leg of the retainer and the upper surface of the bracket. The shim can be wedged between the upper surface of the bracket and the projection of the retainer in order to lock the retainer in place. For example, such a shim 229 is shown in FIG. 2C between bracket 260 and retainer 220. In some embodiments, the shim is tapered so that further insertion of the shim between the projection and bracket surface increases the hold between the retainer and bracket. Further, in some embodiments, the shim is U-shaped so that it can engage with projections on both sides of the T-slot. In such a case, the shim may be inserted from one side to engage both projections. In other embodiments, the shim may be configured to operate on only one side of the T-slot. In such embodiments, two shims may be used to engage opposing projections of the retainer.

Figure 1B:
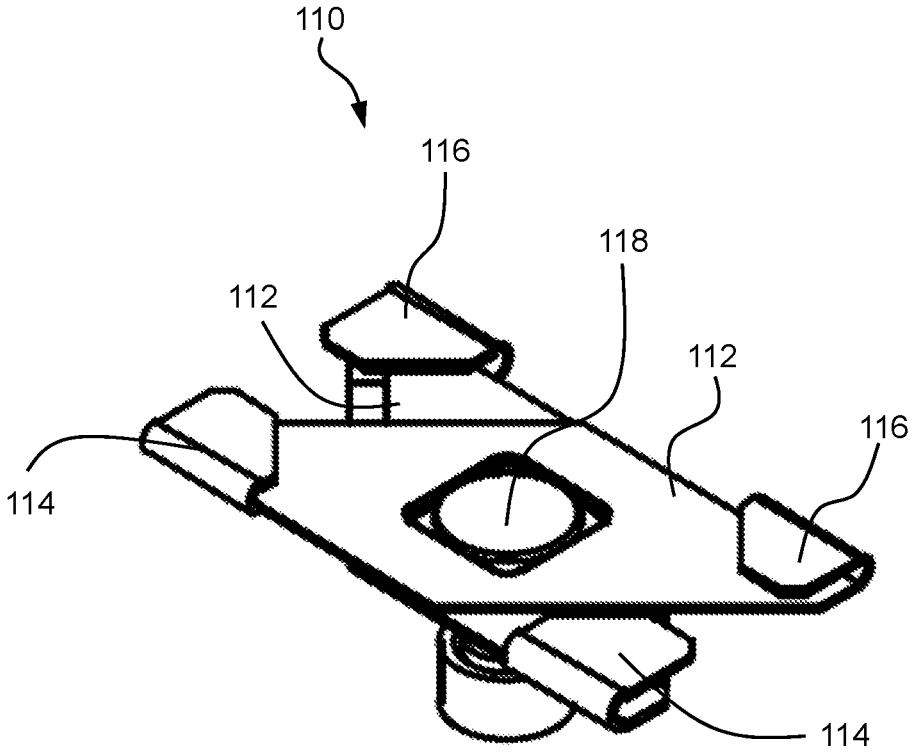
FIG. 1B is a schematic perspective view of a ceiling grid clip of the ceiling system of FIG. 1A.
Figure 1C:
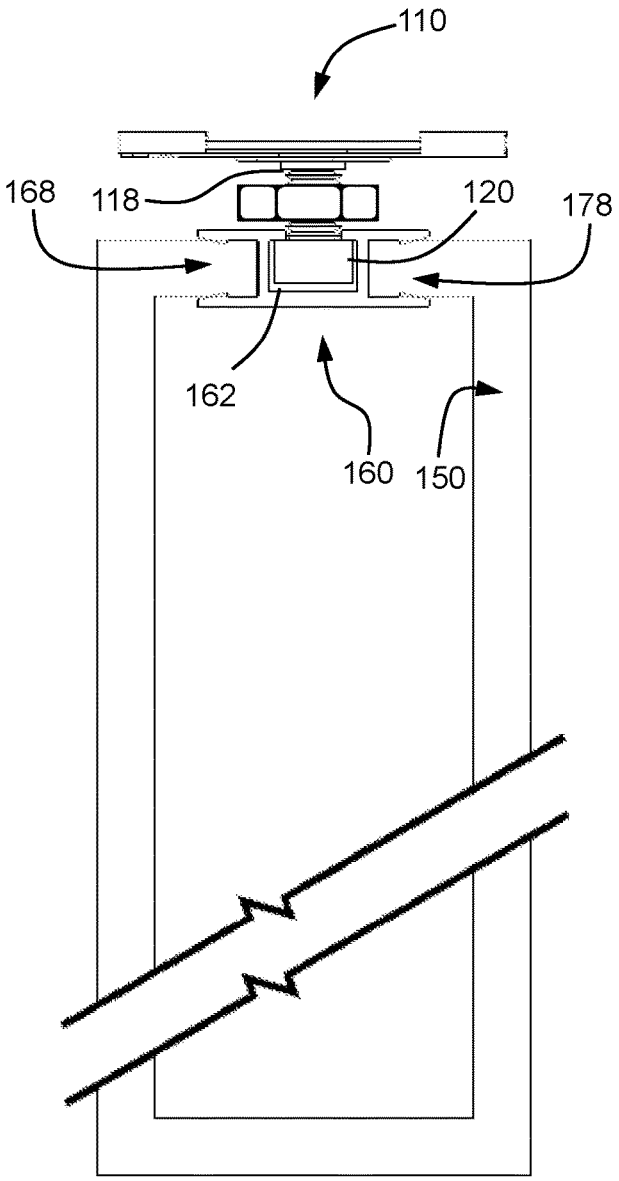
FIG. 1D is a side view of a portion of the ceiling system of FIG. 1A in a disconnected position.

In certain embodiments of the ceiling baffle attachment structure as otherwise described herein, the ceiling grid clip is a scissor clip including a pair of clip members, each of the clip members being configured to engage both flanges of the ceiling grid beam. For example, ceiling grid beam 102 is configured as a T-beam and includes a pair of flanges 104 extending outward from a central web 106 that extends up to a bulb 108 at the top of ceiling grid beam 102. Ceiling grid clip 110 of ceiling system 100 is configured to attach to the flange 104 of ceiling grid beam 102. Specifically, as shown in FIG. 1B, ceiling grid clip 110 includes a pair of clip members 112, each of which can articulate about post 118. Further each of the clip members 112 includes a first hook 114 configured to attach to one flange of the ceiling grid beam 102 and a second hook 116 configured to attach to the other flange. To secure ceiling grid clip 110 to ceiling grid beam 102, the clip members 112 are initially positioned so that the ceiling grid clip can be placed against the bottom of ceiling grid beam 102 with the hooks 114, 116 passing the flanges 104. The clip members 112 are then rotated in opposite directions so that the hooks 114, 116 engage the flanges and are fixed to the ceiling grid beam 102.

In other embodiments, the ceiling grid clip is a twist-on clip including a single clip member configured to engage both flanges of the ceiling grid beam. Such a twist-on clip operates similarly to one of the clip members of a scissor clip. In particular, the twist-on clip can be placed against the bottom of the ceiling grid beam with a pair of hooks passing the flanges of the ceiling grid beam. The twist-on clip is then rotated, or twisted, so that the hooks engage the flanges of the ceiling grid beam. Still, in other embodiments, the ceiling grid clip may have another configuration, such as a clip that is pushed onto the grid beam and snaps into place.

In certain embodiments of the ceiling baffle attachment structure as otherwise described herein, the ceiling baffle further comprises a body secured to the bracket. For example, baffle 140 of ceiling system 100 includes a body 150 that is formed a separate piece that is secured to bracket 160 and extends downward therefrom. In other embodiments, the body of the baffle may be integrally formed with the bracket. For example, in some embodiments, the baffle is formed as a single piece with the upper portion forming the bracket of the baffle and a lower portion extending downward to form the body of the baffle.

In certain embodiments of the ceiling baffle attachment structure as otherwise described herein, the body of the ceiling baffle forms a first face, the lower side, and a second face of the ceiling baffle. For example, as shown in FIG. 1A, body 150 of baffle 140 is attached at its upper end to bracket 160 and extends downward therefrom to form the first face 152, second face 153 and lower side 143 of baffle 140.

In other embodiments, the faces of the baffle and the lower side may be formed of separate components. For example, in some embodiments, the bracket may extend through the center of the baffle and form the lower end of the baffle, with lateral faces of the baffle being formed by a separate piece. Other configurations with more or fewer pieces are also possible.

In certain embodiments of the ceiling baffle attachment structure as otherwise described herein, the body of the ceiling baffle is hollow. For example, in some embodiments, the body of the baffle is formed with a hollow cross section in the form of a loop or U-shape that is attached at the top to the bracket. For example, body 150 of baffle 140 has a substantially U-shaped cross-section with a hollow interior. The hollow interior can reduce the weight of the baffle, thereby reducing the loads on the attachment system and ceiling grid.

In certain embodiments of the ceiling baffle attachment structure as otherwise described herein, the body of the ceiling baffle is felt. For example, body 150 of baffle 140 is formed of a sheet of felt that shaped with corners to form a rectangular cross section. Opposing edges of the felt sheet are secured to the bracket 160 so as to form a hollow interior. Felt can provide a warm aesthetic and has beneficial acoustic properties.

Figure 3:
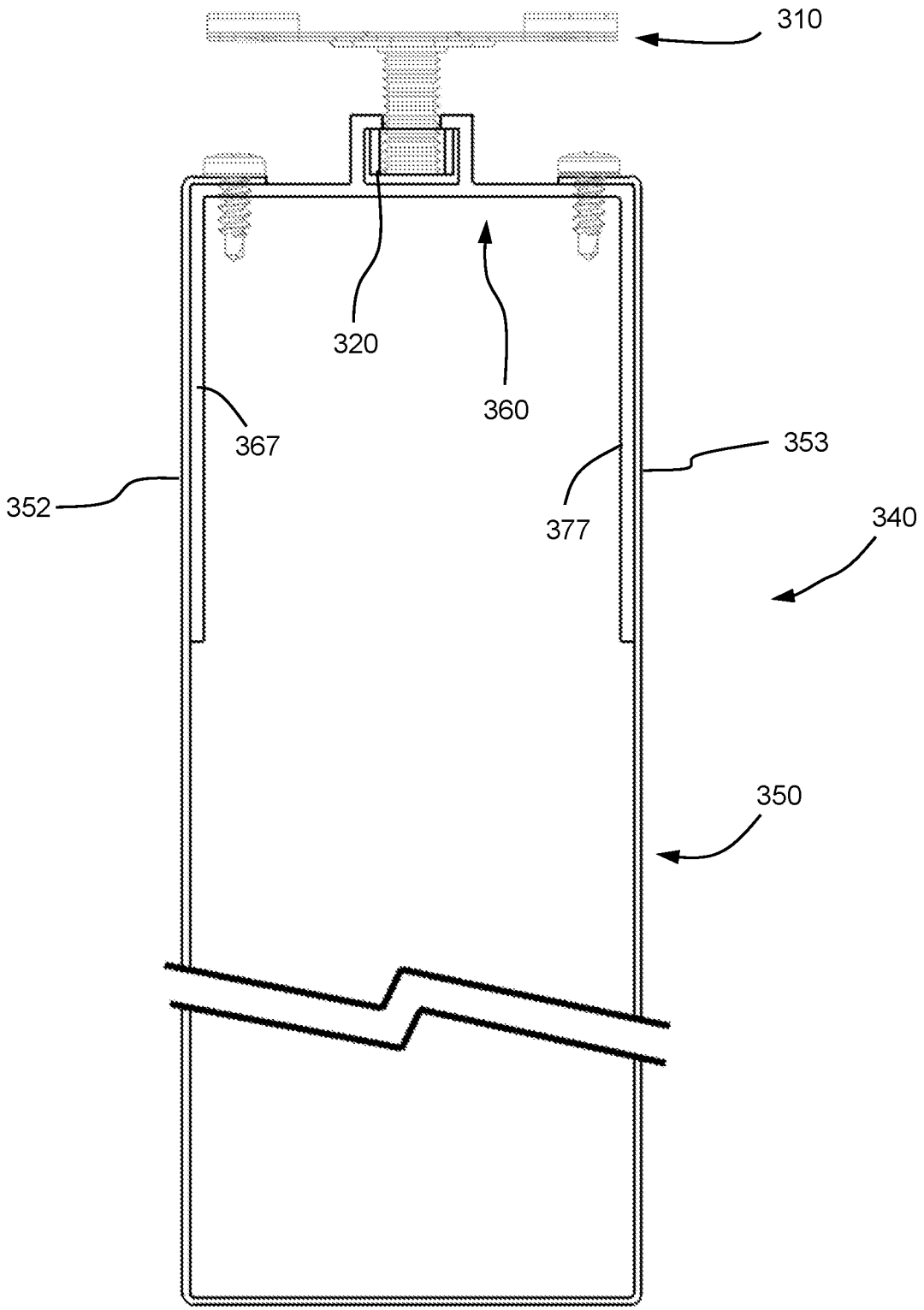
FIG. 3 is a side view of a portion of ceiling system according to another embodiment of the disclosure.

In other embodiments, the body of the ceiling baffle is a bent metal sheet. A cross-section of such an embodiment is shown in FIG. 3. The configuration shown in FIG. 3 has a baffle 340 including a bracket 360 at its upper end and a body 350 extending downward therefrom. Baffle 340 is configured to be held to ceiling grid beam using a ceiling grid clip 310 and retainer 320. The body 350 of baffle 340 is formed of a metal sheet, and similar to the felt embodiment of FIG. 1A, the body 350 is bent into a rectangular cross section and opposing edges of the metal sheet are secured to bracket 360 so as to form a hollow interior.

While the configuration in FIG. 3 includes a ceiling grid clip 310 in the form of a scissor clip and a retainer 320 in the form of a washer, similar to ceiling system 100, in other embodiments, a baffle with a configuration similar to baffle 340 may be attached to a ceiling grid beam using another type of ceiling grid clip, such as a twist-on or other clip, and could be suspended by another retainer, such as the clip retainer shown in FIG. 2A or another retainer.

The term metal sheet, as used herein is not limited in thickness, and may include materials commonly referred to as sheet metal, metal foil or metal plate.

In other embodiments, the body of the ceiling baffle is formed of another material. For example, in some embodiments, the body of the baffle is formed of wood, bamboo, foam, glass, fiberglass, polymer or another material. Likewise, in some embodiments, the body of the ceiling baffle is not hollow. For example, in some embodiments, the body of the ceiling baffle may be formed of an extruded or otherwise formed solid metal piece. Likewise, in some embodiments, the body may be formed of a solid piece formed of wood, bamboo, foam, glass, fiberglass, polymer or another material. The term solid, as used herein, does not exclude porous materials, but rather is used to distinguish from hollow bodies.

In certain embodiments of the ceiling baffle attachment structure as otherwise described herein, a width of the ceiling baffle is at least ½ inch, e.g., at least ¾ inch. Further, in some embodiments, the width of the ceiling baffle is no more than 6 inches, e.g., no more than 4 inches. For example, in some embodiments the width of the baffle is in a range from ½ inch to 6 inches, e.g., from ¾ inch to 4 inches.

In certain embodiments of the ceiling baffle attachment structure as otherwise described herein, a height of the ceiling baffle is at least 4 inches, e.g., at least 6 inches. Further, in some embodiments, the height of the ceiling baffle is no more than 4 feet, e.g., no more than 2 feet. For example, in some embodiments the height of the baffle is in a range from 4 inches to 4 feet, e.g., from 6 inches to 2 feet.

While the cross-section of each of the baffles shown in the figures is rectangular, in other embodiments, the baffles may have another cross-sectional shape. For example, in some embodiments, the baffles have a different polygonal cross-section, such as a triangle, square or a shape with more than four sides. Likewise, in some embodiments, the baffles have an elliptical or oval cross section. Further, in some embodiments, the baffles have complex shape, such as a canoe, blade, teardrop or other shape.

In certain embodiments of the ceiling baffle attachment structure as otherwise described herein, a length of the ceiling baffle is at least 4 feet, e.g., at least 6 feet. Further, in some embodiments, the length of the baffle is no more than 40 feet, e.g., no more than 20 feet. For example, in some embodiments, the length of the baffles is in a range from 4 feet to 40 feet, e.g., from 6 feet to 20 feet.

Figure 1D:
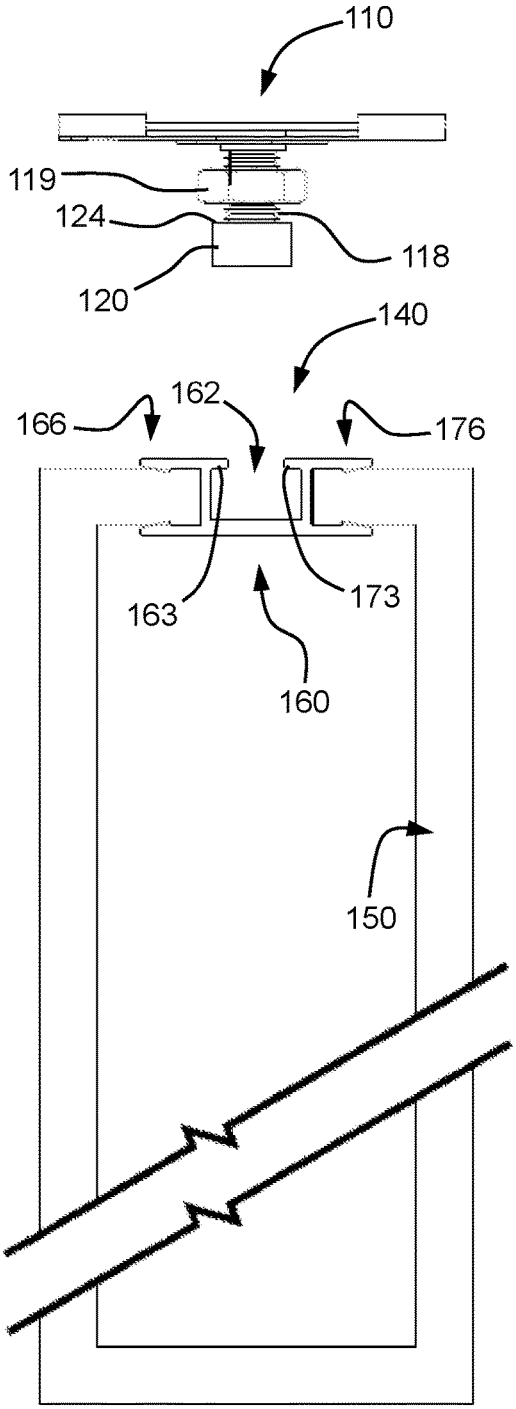

In certain embodiments of the ceiling baffle attachment structure as otherwise described herein, the bracket includes a frame having opposing first and second arms that extend outward from the T-slot. For example, bracket 160 of ceiling baffle 140, as illustrated in FIG. 1D has a frame that includes a first arm 166 extending outward from the T-slot 162 in a first direction and a second arm 176 extending outward from the T-slot in a second direction. As explained in more detail below, the arms of the bracket can be used in various manners to secure the body of the baffle to the bracket.

In certain embodiments of the ceiling baffle attachment structure as otherwise described herein, the bracket extends across a width of the baffle. For example, in baffle 340, shown in FIG. 3, bracket 360 extends substantially across the entire width of baffle 340 from the first face 352 of baffle 340 to the second face 353 of baffle 340, with the body 350 of baffle 340 wrapping tightly around the sides of bracket 360. In other embodiments, the body of the baffle extends outward from the bracket and is wider than the bracket. For example, as shown in FIG. 10, the body 150 of baffle 140 extends laterally outward further than the sides of bracket 160.

In certain embodiments of the ceiling baffle attachment structure as otherwise described herein, each of the first and second arms of the bracket includes a slot configured to receive a respective edge of the body of the ceiling baffle. For example, as explained above with respect to ceiling system 100, the edges of the felt body 150 of baffle 140 are secured to bracket 160. As illustrated in FIG. 10, the edges are inserted into respective slots 168, 178 on opposing sides of T-slot 162.

Figure 4:
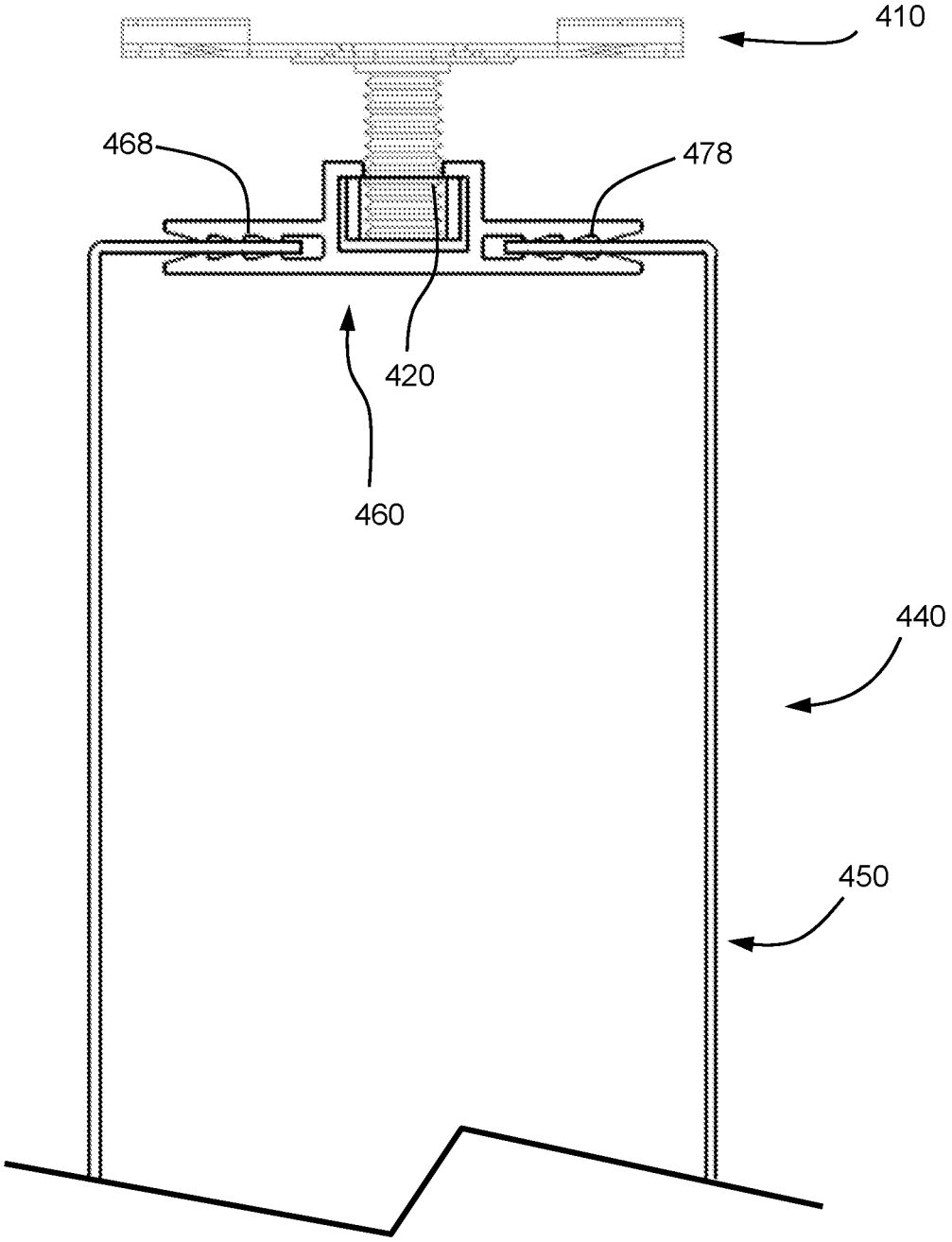
FIG. 4 is a side view of a portion of ceiling system according to yet another embodiment of the disclosure.

FIG. 4 shows a cross-section of another bracket including slots configured to receive the body of a baffle. The configuration shown in FIG. 4 has a baffle 440 including a bracket 460 at its upper end and a body 450 extending downward therefrom. Baffle 440 is configured to be held to a ceiling grid beam using a ceiling grid clip 410 and retainer 420. The body 450 of baffle 440 is formed of a metal sheet that is inserted into slots 468, 478 on opposing sides of the T-slot.

While the configuration in FIG. 4 includes a ceiling grid clip 410 in the form of a scissor clip and a retainer 420 in the form of a washer, in other embodiments, a baffle with a configuration similar to baffle 440 may be attached to a ceiling grid beam using another type of ceiling grid clip, such as a twist-on or other clip, and could be suspended by another retainer, such as a clip retainer or another retainer.

Figure 5:
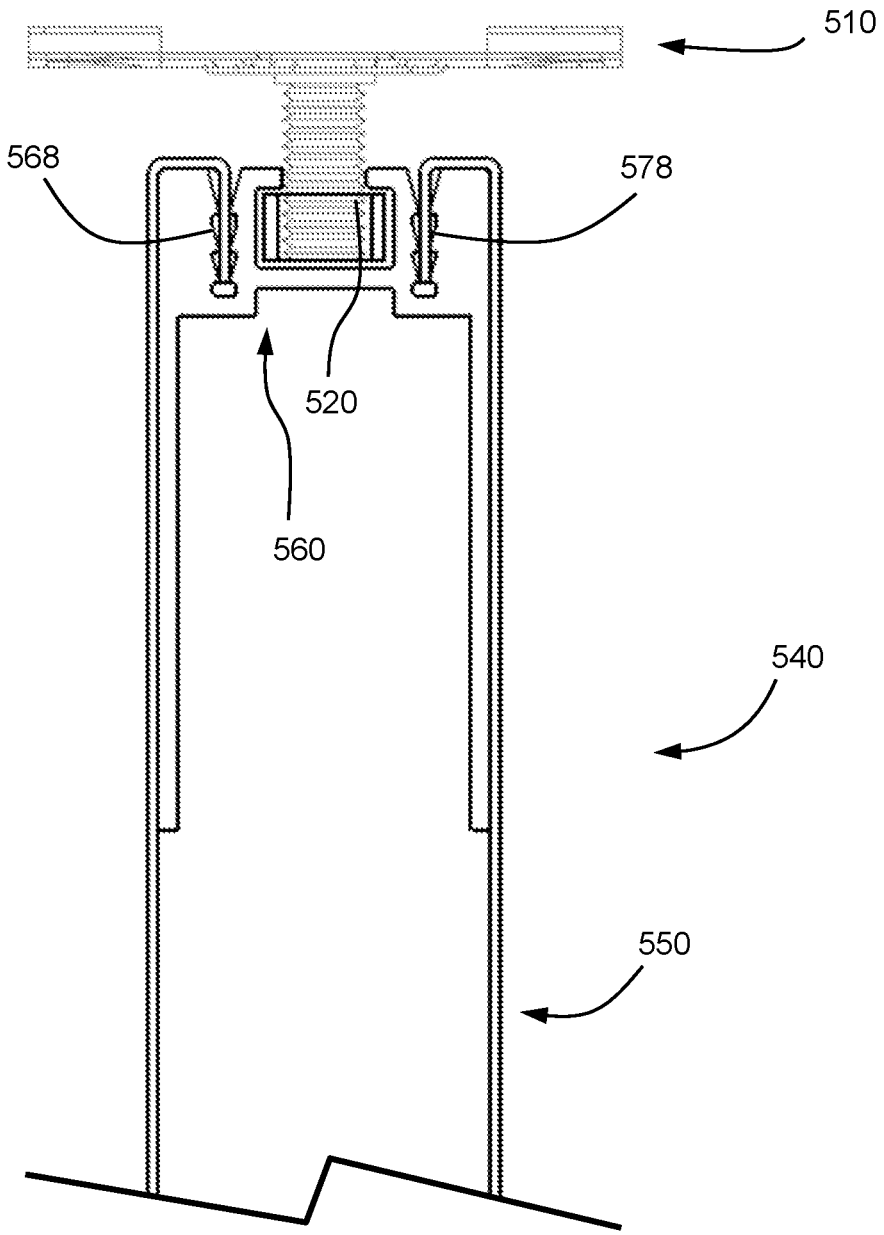
FIG. 5 is a side view of a portion of ceiling system according to another embodiment of the disclosure.

In some embodiments, as in bracket 160 and bracket 460, the slots extend inward from the sides of the bracket. In other embodiments the slots extend down from a top of the bracket. FIG. 5 shows a cross-section of a bracket including downward slots. The configuration shown in FIG. 5 has a baffle 540 including a bracket 560 at its upper end and a body 550 extending downward therefrom. Baffle 540 is configured to be held to a ceiling grid beam using a ceiling grid clip 510 and retainer 520. The body 550 of baffle 540 is formed of a metal sheet that is inserted into downward slots 568, 578 on opposing sides of T-slot 562.

While the configuration in FIG. 5 includes a ceiling grid clip 510 in the form of a scissor clip and a retainer 520 in the form of a washer, in other embodiments, a baffle with a configuration similar to baffle 540 may be attached to a ceiling grid beam using another type of ceiling grid clip, such as a twist-on or other clip, and could be suspended by another retainer, such as a clip retainer or another retainer.

In certain embodiments of the ceiling baffle attachment structure as otherwise described herein, the slots include tines to secure the body of the baffle. For example, the slots of the embodiments of FIGS. 1, 4 and 5 each include a tines that extend inward into the opening of the slot. Such tines can be used to bite into the surface of the body of the baffle so as to hinder removal of the edges of the body from the slots. In some embodiments, the tines are configured as projections that run along the length of the bracket. In other embodiments, the tines are configured as distinct indentations along the length of the bracket.

Figure 6:
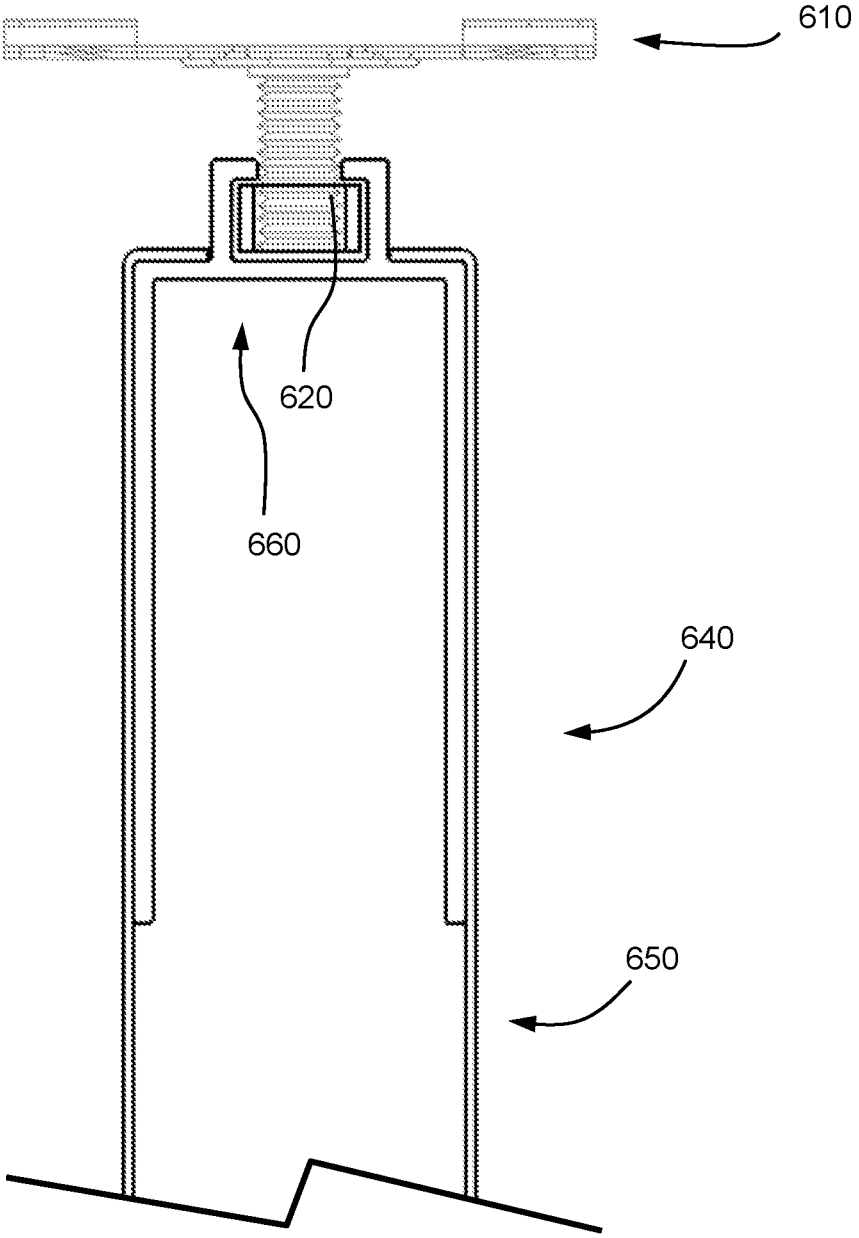
FIG. 6 is a side view of a portion of ceiling system according to still another embodiment of the disclosure.

In other embodiments, the body of the baffle is secured to the bracket without the use of slots. Baffle 340 shown in FIG. 3 shows such an embodiment. Rather than using slots, the body 350 of baffle 340 is secured to bracket 360 using mechanical fasteners. FIG. 6 shows another embodiment of a baffle where the body of the baffle is secured to the bracket without the use of slots. The configuration shown in FIG. 6 has a baffle 640 including a bracket 660 at its upper end and a body 650 extending downward therefrom. Baffle 640 is configured to be held to a ceiling grid beam using a ceiling grid clip 610 and retainer 620. The body 650 of baffle 640 is formed of a metal sheet that wraps around bracket 660 and is secured to bracket 660 using an adhesive.

While the configuration in FIG. 6 includes a ceiling grid clip 610 in the form of a scissor clip and a retainer 620 in the form of a washer, in other embodiments, a baffle with a configuration similar to baffle 640 may be attached to a ceiling grid beam using another type of ceiling grid clip, such as a twist-on or other clip, and could be suspended by another retainer, such as a clip retainer or another retainer.

In certain embodiments of the ceiling baffle attachment structure as otherwise described herein, the bracket includes first and second side walls that extend down from the first and second arms, respectively. Such an embodiment is shown in FIG. 3. Bracket 360 of baffle 340 includes opposing first and second walls 367, 377 that extend downward at the sides of bracket 360. These walls 367, 377 can help support the body 350 of baffle 340. In other embodiments, such as in baffle 140, the bracket does not include such walls.

In certain embodiments of the ceiling baffle attachment structure as otherwise described herein, the bracket has a uniform cross section along a length of the bracket. For example, in some embodiments, the bracket is extruded along its length such that the cross-section of the bracket is uniform. For example, in some embodiments, the bracket is an extruded metal, such as aluminum, or a polymer. Alternatively, in some embodiments, the bracket is formed by another method and may or may not include a uniform cross section. Further, in various embodiments, the bracket may be made of a variety of materials, including metals, such as steel, aluminum or iron, polymer materials, wood, bamboo, polymer or composite materials.

In certain embodiments of the ceiling baffle attachment structure as otherwise described herein, the bracket is one of a plurality of brackets disposed along the length of the ceiling baffle. For example, in some embodiments the baffle includes several brackets positioned along its length at evenly spaced intervals. Accordingly, each of the brackets can be used to secure the baffle to a respective ceiling grid beam. For instance, in some embodiments, the baffle includes brackets positioned along the length thereof at 1-foot, 2-foot or 4-foot intervals. In embodiments where the baffle includes multiple brackets, the length of each bracket may be substantially shorter than the length of the baffle. For example, in some embodiments, each of the brackets is several inches long. For instance, in some embodiments, the bracket is at least two inches long, e.g., at least 3 inches long.

In other embodiments, the bracket is longer. For example, in certain embodiments of the ceiling baffle attachment structure as otherwise described herein, the bracket extends over substantially the entire length of the ceiling baffle. For example, in ceiling system 100, bracket 160 of baffle 140 extends from the first end 146 of baffle 140 to the second end 147. The phrase "substantially the entire length," as used herein, refers to a length that is at least 80% of the length of the baffle. For example, in some embodiments, the bracket extends over the majority of the length of the baffle, with a portion of the body of the baffle extending beyond the end of bracket. Such an embodiment can hide the bracket from view. In other embodiments, the bracket extends to within one inch of the ends of the body of the baffle. Still, in other embodiments, the bracket extends all the way to the ends of the baffle and is coextensive with the body of the baffle. Thus, similar to the overall baffle, in some embodiments, the bracket has a length of no more than 40 feet, e.g., no more than 20 feet.

In certain embodiments of the ceiling baffle attachment structure as otherwise described herein, the bracket has a width of at least ½ inch, e.g., at least ¾ inch. Further, in some embodiments, the bracket has a width of no more than 6 inches, e.g., no more than 4 inches. For example, in some embodiments, the bracket has a width in a range from % inch to 6 inches, e.g., from ¾ inch to 4 inches.

Figure 7:
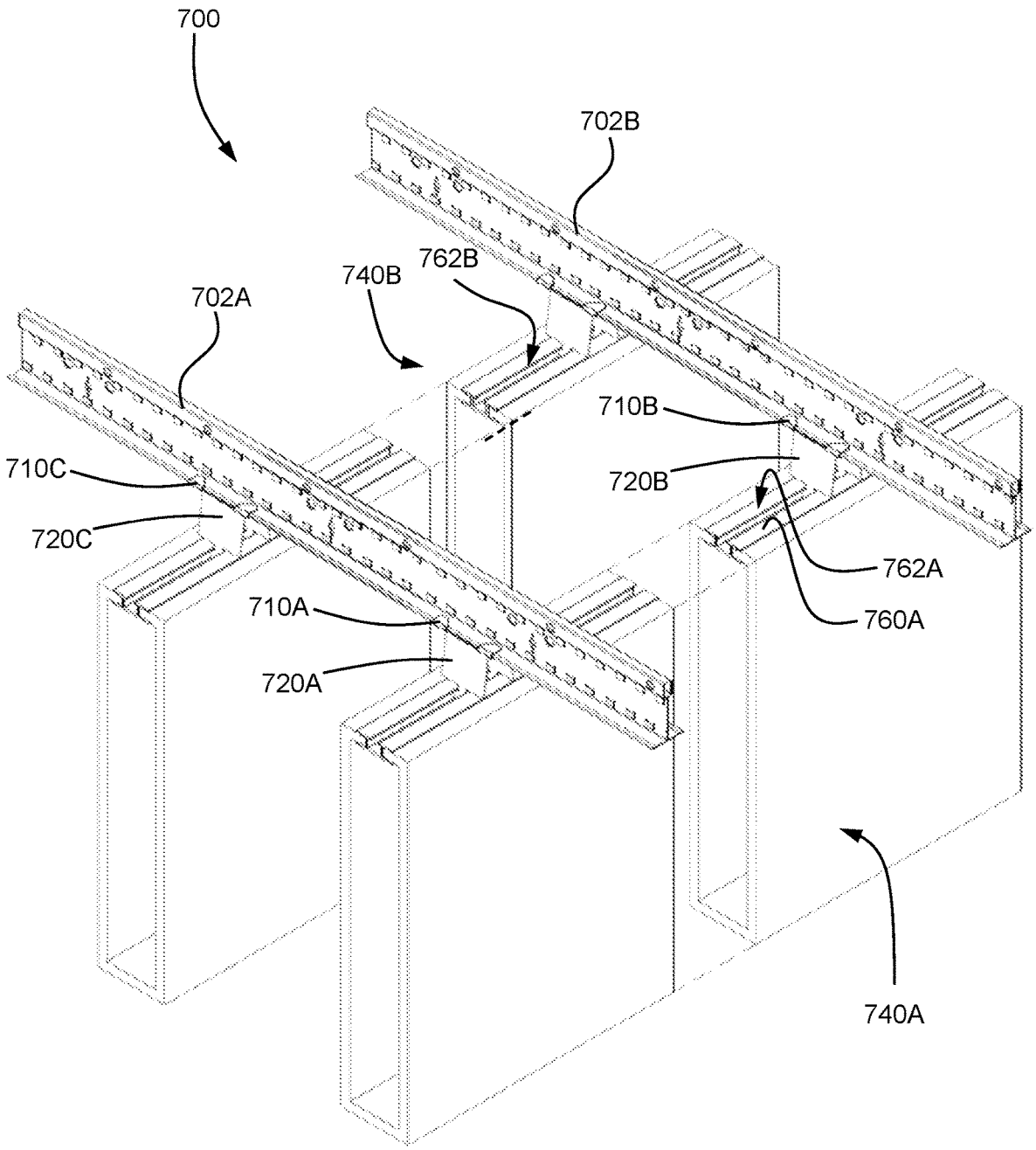
FIG. 7 is a perspective view of a ceiling system according to another embodiment of the disclosure.

In another aspect, the disclosure provides a ceiling system that includes a ceiling grid comprising a plurality of ceiling grid beams including a first ceiling grid beam. A first ceiling baffle is attached to the first ceiling grid beam using a ceiling baffle attachment structure according to the disclosure. FIG. 7 shows a perspective view of such a ceiling system. Ceiling system 700 includes a first ceiling grid beam 702A and a first ceiling baffle 740A attached to the first ceiling grid beam 702A. Similar to ceiling system 200 of FIGS. 2A and 2B, first ceiling baffle 740A includes a bracket 760A with a T-slot 762A. A retainer 720A is inserted into the T-slot 762A and is coupled to a ceiling grid clip 710A through a post. The ceiling grid clip 710A holds the post and retainer 720A securely to ceiling grid beam 702A so that first baffle 740A is suspended from ceiling grid beam 702A.

In certain embodiments of the ceiling system as otherwise described herein, the plurality of ceiling grid beams includes a second ceiling grid beam, and the first ceiling baffle is attached to the second ceiling grid beam using a second ceiling grid clip, a second post and a second retainer engaging the T-slot of the bracket of the first ceiling baffle. For example, ceiling system 700 also includes a second ceiling grid beam 702B and the first ceiling baffle 740A is attached to the second ceiling grid beam 702B using a second ceiling grid clip 710B and second retainer 720B. Like the first retainer 720A, the second retainer 720B is also inserted into the T-slot 762A of first baffle 740A.

In other embodiments, the first ceiling baffle includes a second bracket, and the first ceiling baffle is attached to the second ceiling grid beam using a second ceiling grid clip, a second post, and a second retainer engaging a T-slot of the second bracket of the first ceiling baffle.

In certain embodiments of the ceiling system as otherwise described herein, the second ceiling grid beam is parallel to the first ceiling grid beam. For example, in ceiling system 700, first ceiling grid beam 702A and second ceiling grid beam 702B are parallel to one another. In other embodiments, the first baffle may be attached to grid beams that are disposed at an angle to one another.

In certain embodiments of the ceiling system as otherwise described herein, the system further includes a second ceiling baffle attached to the first ceiling grid beam using another ceiling baffle attachment structure according to the disclosure. For example, ceiling system 700 also includes a second baffle 740B attached to first ceiling grid beam 702A using another ceiling grid clip 710C and another retainer 720C inserted into a T-slot 762B of second baffle 740B.

In certain embodiments of the ceiling system as otherwise described herein, the second ceiling baffle is parallel to the first ceiling baffle. For example, in ceiling system 700, first ceiling baffle 740A and second ceiling baffle 740B are parallel to one another. In other embodiments, the first and second ceiling baffles baffle may be disposed at an angle to one another.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

EMBODIMENTS

Embodiment 1. A ceiling baffle attachment structure comprising:

- a ceiling grid clip configured to attach to lateral flanges of a ceiling grid beam;
- a post extending down from the ceiling grid clip;
- a ceiling baffle having an upper side and a lower side and extending along a length from a first end to a second end, the ceiling baffle including a bracket disposed at the upper side that comprises a T-slot extending along the length of the ceiling baffle; and
- a retainer secured to the post, the retainer including a first shoulder engaging the T-slot so as to secure the ceiling baffle to the ceiling grid clip.

Embodiment 2. The ceiling baffle attachment structure according to embodiment 1, wherein the retainer is an annular element that surrounds the post and is captured in the T-slot.

Embodiment 3. The ceiling baffle attachment structure according to embodiment 1 or embodiment 2, wherein the post is threaded.

Embodiment 4. The ceiling baffle attachment structure according to embodiment 3, further comprising a nut disposed on the post, wherein the nut secures the bracket against the retainer.

Embodiment 5. The ceiling baffle attachment structure according to embodiment 3 or embodiment 4, wherein the retainer engages the threads of the post.

Embodiment 6. The ceiling baffle attachment structure according to any of embodiments 1 to 5, wherein the retainer is bonded to the post.

Embodiment 7. The ceiling baffle attachment structure according to embodiment 1, wherein the retainer is a clip including a first leg that extends into the T-slot, and wherein the first shoulder extends laterally outward from the first leg.

Embodiment 8. The ceiling baffle attachment structure according to embodiment 7, wherein the retainer includes a second shoulder extending laterally outward from the first leg opposite the first shoulder.

Embodiment 9. The ceiling baffle attachment structure according to embodiment 8, wherein the retainer includes a second leg that extends into the T-slot, and wherein third and fourth shoulders extend laterally outward from the second leg so as to engage the T-slot.

Embodiment 10. The ceiling baffle attachment structure according to any of embodiments 7 to 9, wherein the first leg includes a projection that extends over an upper surface of the bracket.

Embodiment 11. The ceiling baffle attachment structure according to embodiment 10, further comprising a shim disposed between the projection of the first leg of the retainer and the upper surface of the bracket.

Embodiment 12. The ceiling baffle attachment structure according to any of embodiments 1 to 11, wherein the ceiling baffle further comprises a body secured to the bracket.

Embodiment 13. The ceiling baffle attachment structure according to embodiment 12, wherein the body of the ceiling baffle forms a first face, the lower side, and a second face of the ceiling baffle.

Embodiment 14. The ceiling baffle attachment structure according to embodiment 12 or embodiment 13, wherein the body of the ceiling baffle is hollow.

Embodiment 15. The ceiling baffle attachment structure according to any of embodiments 12 to 14, wherein the body of the ceiling baffle is felt.

Embodiment 16. The ceiling baffle attachment structure according to any of embodiments 12 to 14, wherein the body of the ceiling baffle is a bent metal sheet.

Embodiment 17. The ceiling baffle attachment structure according to any of embodiments 1 to 16, wherein a width of the ceiling baffle is at least % inch, e.g., at least % inch.

Embodiment 18. The ceiling baffle attachment structure according to any of embodiments 1 to 17, wherein a width of the ceiling baffle is no more than 6 inches, e.g., no more than 4 inches.

Embodiment 19. The ceiling baffle attachment structure according to any of embodiments 1 to 18, wherein a height of the ceiling baffle is at least 4 inches, e.g., at least 6 inches.

Embodiment 20. The ceiling baffle attachment structure according to any of embodiments 1 to 19, wherein a height of the ceiling baffle is no more than 4 feet, e.g., no more than 2 feet.

Embodiment 21. The ceiling baffle attachment structure according to any of embodiments 1 to 20, wherein a length of the ceiling baffle is at least 4 feet, e.g., at least 6 feet.

Embodiment 22. The ceiling baffle attachment structure according to any of embodiments 1 to 21, wherein a length of the ceiling baffle is no more than 40 feet, e.g., no more than 20 feet.

Embodiment 23. The ceiling baffle attachment structure according to any of embodiments 1 to 22, wherein the bracket includes a frame having opposing first and second arms that extend outward from the T-slot.

Embodiment 24. The ceiling baffle attachment structure according to embodiment 23, wherein the bracket extends across a width of the baffle.

Embodiment 25. The ceiling baffle attachment structure according to embodiment 23 or embodiment 24, wherein each of the first and second arms of the bracket includes a slot configured to receive a respective edge of the body of the ceiling baffle.

Embodiment 26. The ceiling baffle attachment structure according to embodiment 25, wherein the slots extend inward from the sides of the bracket.

Embodiment 27. The ceiling baffle attachment structure according to embodiment 25, wherein the slots extend down from the top of the bracket.

Embodiment 28. The ceiling baffle attachment structure according to any of embodiments 25 to 27, wherein the slots include tines to secure the body of the baffle.

Embodiment 29. The ceiling baffle attachment structure according to any of embodiments 23 to 28, wherein the bracket includes first and second side walls that extend down from the first and second arms, respectively.

Embodiment 30. The ceiling baffle attachment structure according to any of embodiments 1 to 29, wherein the bracket has a uniform cross section along a length of the bracket.

Embodiment 31. The ceiling baffle attachment structure according to any of embodiments 1 to 30, wherein the bracket is one of a plurality of brackets disposed along the length of the ceiling baffle.

Embodiment 32. The ceiling baffle attachment structure according to any of embodiments 1 to 30, wherein the bracket extends over substantially the entire length of the ceiling baffle.

Embodiment 33. The ceiling baffle attachment structure according to any of embodiments 1 to 32, wherein the bracket has a length of at least 2 inches, e.g., at least 3 inches.

Embodiment 34. The ceiling baffle attachment structure according to any of embodiments 1 to 33, wherein the bracket has a length of no more than 40 feet, e.g., no more than 20 feet.

Embodiment 35. The ceiling baffle attachment structure according to any of embodiments 1 to 34, wherein the bracket has a width of at least % inch, e.g., at least % inch.

Embodiment 36. The ceiling baffle attachment structure according to any of embodiments 1 to 35, wherein the bracket has a width of no more than 6 inches, e.g., no more than 4 inches.

Embodiment 37. The ceiling baffle attachment structure according to any of embodiments 1 to 36, wherein the ceiling grid clip is a scissor clip including a pair of clip members, each of the clip members being configured to engage both flanges of the ceiling grid beam.

Embodiment 38. The ceiling baffle attachment structure according to any of embodiments 1 to 36, wherein the ceiling grid clip is a twist-on-clip including a single clip member configured to engage both flanges of the ceiling grid beam.

Embodiment 39. A ceiling system comprising:

a ceiling grid comprising a plurality of ceiling grid beams including a first ceiling grid beam; and a first ceiling baffle attached to the first ceiling grid beam using a ceiling baffle attachment structure according to any of embodiments 1 to 38.

Embodiment 40. The ceiling system according to embodiment 39, wherein the plurality of ceiling grid beams includes a second ceiling grid beam, and wherein the first ceiling baffle is attached to the second ceiling grid beam using a second ceiling grid clip, a second post and a second retainer engaging the T-slot of the bracket of the first ceiling baffle.

Embodiment 41. The ceiling system according to embodiment 39, wherein the plurality of ceiling grid beams includes a second ceiling grid beam, wherein the first ceiling baffle includes a second bracket, and wherein the first ceiling baffle is attached to the second ceiling grid beam using a second ceiling grid clip, a second post and a second retainer engaging a T-slot of the second bracket of the first ceiling baffle.

Embodiment 42. The ceiling system according to embodiment 39 or embodiment 40, wherein the second ceiling grid beam is parallel to the first ceiling grid beam.

Embodiment 43. The ceiling system according to any of embodiments 40 to 42, further comprising a second ceiling baffle attached to the first ceiling grid beam using another ceiling baffle attachment structure according to any of embodiments 1 to 38.

Embodiment 44. The ceiling system according to embodiment 43, wherein the second ceiling baffle is parallel to the first ceiling baffle.

What is claimed is:

1. A ceiling baffle attachment structure comprising:

a ceiling grid clip configured to attach to lateral flanges of a ceiling grid beam;

a post extending down from the ceiling grid clip;

a ceiling baffle having an upper side and a lower side and extending along a length from a first end to a second end, the ceiling baffle including a bracket disposed at the upper side that comprises a T-slot extending along an entirety of the length of the ceiling baffle; and a retainer secured to the post, the retainer including a first shoulder engaging the T-slot of the bracket so as to secure the ceiling baffle to the ceiling grid clip.

2. The ceiling baffle attachment structure according to claim 1, wherein the bracket is one of a plurality of brackets disposed along the entire length of the ceiling baffle.

3. The ceiling baffle attachment structure according to claim 1, wherein the ceiling grid clip is a scissor clip including a pair of clip members, each of the clip members being configured to engage both flanges of the ceiling grid beam.

4. The ceiling baffle attachment structure according to claim 1, wherein the ceiling grid clip is a twist-on-clip including a single clip member configured to engage both flanges of the ceiling grid beam.

5. The ceiling baffle attachment structure according to claim 1, wherein the retainer is an annular element that surrounds the post and is captured in the T-slot.

6. The ceiling baffle attachment structure according to claim 5, wherein the post is threaded, and further comprising a nut disposed on the post, wherein the nut secures the bracket against the retainer.

7. The ceiling baffle attachment structure according to claim 1, wherein the bracket includes a frame having opposing first and second arms that extend outward from the T-slot.

8. The ceiling baffle attachment structure according to claim 7, wherein the ceiling baffle further comprises a body secured to the bracket.

9. The ceiling baffle attachment structure according to claim 8, wherein each of the first and second arms of the bracket includes a slot configured to receive a respective edge of the body of the ceiling baffle.

10. The ceiling baffle attachment structure according to claim 9, wherein the slots include tines to secure the body of the baffle.

11. The ceiling baffle attachment structure according to claim 1, wherein the retainer is a clip including a first leg that extends into the T-slot, and wherein the first shoulder extends laterally outward from the first leg.

12. The ceiling baffle attachment structure according to claim 11, wherein the retainer includes a second shoulder extending laterally outward from the first leg opposite the first shoulder.

13. The ceiling baffle attachment structure according to claim 12, wherein the retainer includes a second leg that extends into the T-slot, and wherein third and fourth shoulders extend laterally outward from the second leg so as to engage the T-slot.

14. The ceiling baffle attachment structure according to claim 11, wherein the first leg includes a projection that extends over an upper surface of the bracket.

15. The ceiling baffle attachment structure according to claim 14, further comprising a shim disposed between the projection of the first leg of the retainer and the upper surface of the bracket.

16. A ceiling system comprising:

a ceiling grid comprising a plurality of ceiling grid beams including a first ceiling grid beam; and a first ceiling baffle attached to the first ceiling grid beam using a ceiling baffle attachment structure according to claim 1.

17. The ceiling system according to claim 16, wherein the plurality of ceiling grid beams includes a second ceiling grid beam, wherein the first ceiling baffle includes a second bracket, and wherein the first ceiling baffle is attached to the second ceiling grid beam using a second ceiling grid clip, a second post and a second retainer engaging a T-slot of the second bracket of the first ceiling baffle.

18. The ceiling system according to claim 17, wherein the second ceiling grid beam is parallel to the first ceiling grid beam.

19. The ceiling system according to claim 16, further comprising a second ceiling baffle attached to the first ceiling grid beam using another ceiling baffle attachment structure according to claim 1.

20. The ceiling system according to claim 19, wherein the second ceiling baffle is parallel to the first ceiling baffle.

* * * * *